US007107634B1

(12) United States Patent
Baird

(10) Patent No.: US 7,107,634 B1
(45) Date of Patent: Sep. 19, 2006

(54) METHOD AND APPARATUS FOR CLEANING A CONDUIT

(75) Inventor: Jeffery D. Baird, Ada, OK (US)

(73) Assignee: Shamrock Research & Development, Inc., Ada, OK (US)

( * ) Notice: Subject to any disclaimer, the term of this patent is extended or adjusted under 35 U.S.C. 154(b) by 0 days.

(21) Appl. No.: 11/297,846

(22) Filed: Dec. 8, 2005

(51) Int. Cl.
*E03C 1/28* (2006.01)

(52) U.S. Cl. ..... 4/679; 4/256.1; 137/242

(58) Field of Classification Search ..... 4/256.1, 4/679; 137/242, 247.49, 247.51
See application file for complete search history.

(56) References Cited

U.S. PATENT DOCUMENTS 232,376 A * 9/1880 Staples ..... 137/242
4,700,142 A * 10/1987 Kuckes ..... 340/853.5
6,385,799 B1 * 5/2002 Doyen ..... 4/679

* cited by examiner

*Primary Examiner*—Huyen Le
(74) *Attorney, Agent, or Firm*—Jackson Walker, LLP

(57) ABSTRACT

A conduit cleaning or clearing apparatus and method has a housing assembly connectable to a pipeline. The housing has an inlet and outlet leg joined by a bight portion. A cleaning member is rotatably disposed within the housing and may be rotated from a first unobstructing position to a second cleaning position. In the cleaning position, a plurality of spaced apart blades are able to contact and loosen any build-up in the bight portion. A wiping paddle on the cleaning member urges the loosen build-up out the outlet leg and through the drain line. The paddle cooperates with a locator seat on the housing to retain the cleaning member in an unobstructing position when not cleaning or clearing the bight.

18 Claims, 12 Drawing Sheets

METHOD AND APPARATUS FOR CLEANING A CONDUIT

BACKGROUND OF THE INVENTION

The present invention relates to a method and apparatus for cleaning the fluid flow path in a conduit. The present invention may be utilized to clean drain lines in any application, whether commercial or residential, and is not necessarily limited to sewage systems. More particularly, the present invention relates to an apparatus and method for clearing a build-up in a trap within a drainage system which may be impeding the flow of fluid from the system discharge.

In most drainage systems, traps are provided catch or collect materials passing through the system. In commercial and residential plumbing systems, traps are used to capture items falling into the drain, so that they do not pass directly through the drain line and into the main sewer system. They are also intended to block sewer gas bleed back into the building. However, the traps often accumulate excessive amounts of debris and build-up blocking the drainage flow through the system.

Numerous devices have been utilized to avoid the problems associated with removing the trap to clean or clear the build-up. Such devices include those disclosed in U.S. Pat. Nos. 1,306,925; 2,610,696; 3,783,457; 3,872,521; 4,893,361; and 5,038,816. The existing devices are cumbersome and ineffective. Many of these "solutions" create other problems for the user, including actually interfering with the drainage flow when not in operation. Any device which restricts the full volume flow through the bight of a trap when not in use potentially will cause more problem than it solves.

The present invention allows the user to rotate a cleaning member through the trap bight without removing the trap from connected plumbing and to position the cleaning member such that the full volume flow through the bight diameter is not restricted when the cleaning member is not being rotated. The present invention may be manually operated or attached to a sensor system to periodically rotate the cleaning member either based simply on a selected time interval or dependent upon pressure or flow rate characteristics within the drain system.

While the present invention is described and illustrated in a preferred embodiment within a plumbing/sewer environment, it will be understood that the present invention could be adapted for use in industrial situations where product in a pipeline periodically may need to be flushed or wiped from the pipeline. In such situations, the present invention is not intended to function as a trap, but rather as an inline cleaning or clearing apparatus.

DETAILED DESCRIPTION OF THE PREFERRED EMBODIMENT

Figure 1:
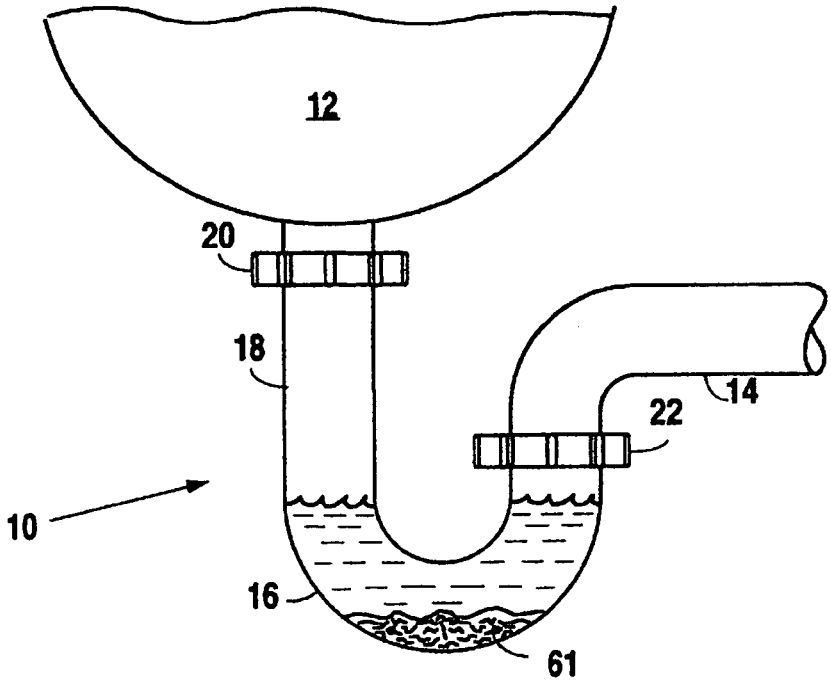
Fig. 1 (PRIOR ART)
FIG. 1 illustrates a prior art, well-known drain trap connected to a sink and a drain line.

FIG. 1 illustrates a typical drain trap 10 attached to a sink 12 and a drain line 14. The J-trap 10 catches objects, such as rings, jewelry, tools, or other precious items, which fall into the sink drain and prevents gases in the sewer system from backing up through the drain line and entering the environment around the sink. The J-trap has a bight portion 16 which bends or curves and allows liquid to collect in the trap preventing gases from traveling from the drain line 14 and up through the inlet leg 18 of the trap. However, build-ups of sludge accumulate in the bottom of the bight portion and reduce the flow of liquids through the trap. In some cases, the build-ups completely block the flow.

Normally, in conventional J-traps, connecting unions 20 and 22 are loosened and the trap removed from the drain line for cleaning. This, however, results in having to take the drain "off line," thereby exposing the environment to the back flow gases in the sewage system and downtime for other drainage applications. The present invention allows a trap to be cleaned without taking the drainage system off line.

Figure 2A:
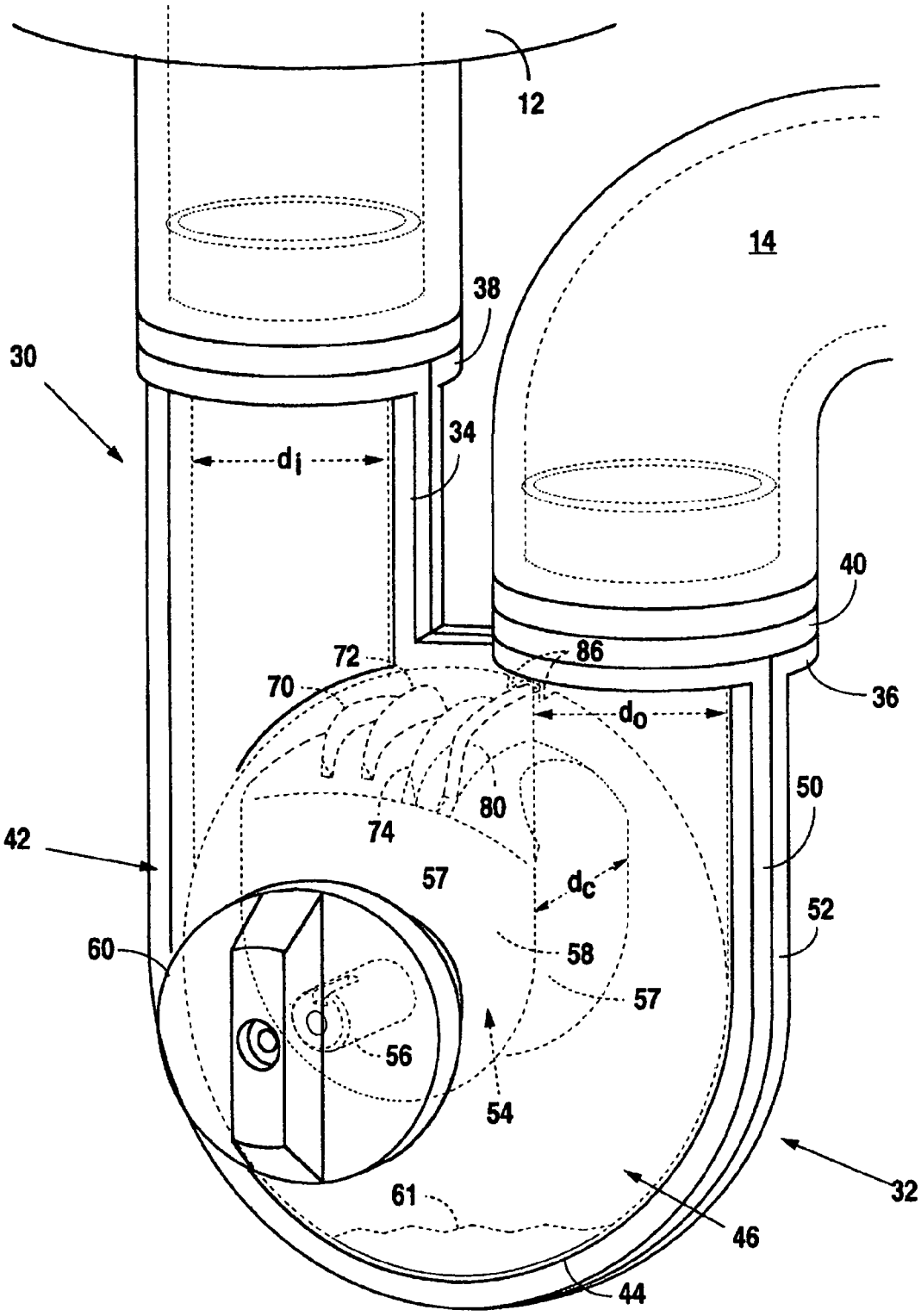
FIG. 2A is a perspective illustration of one embodiment of the present invention connected to a sink and a drain line and in a first unobstructing position.
Figure 2B:
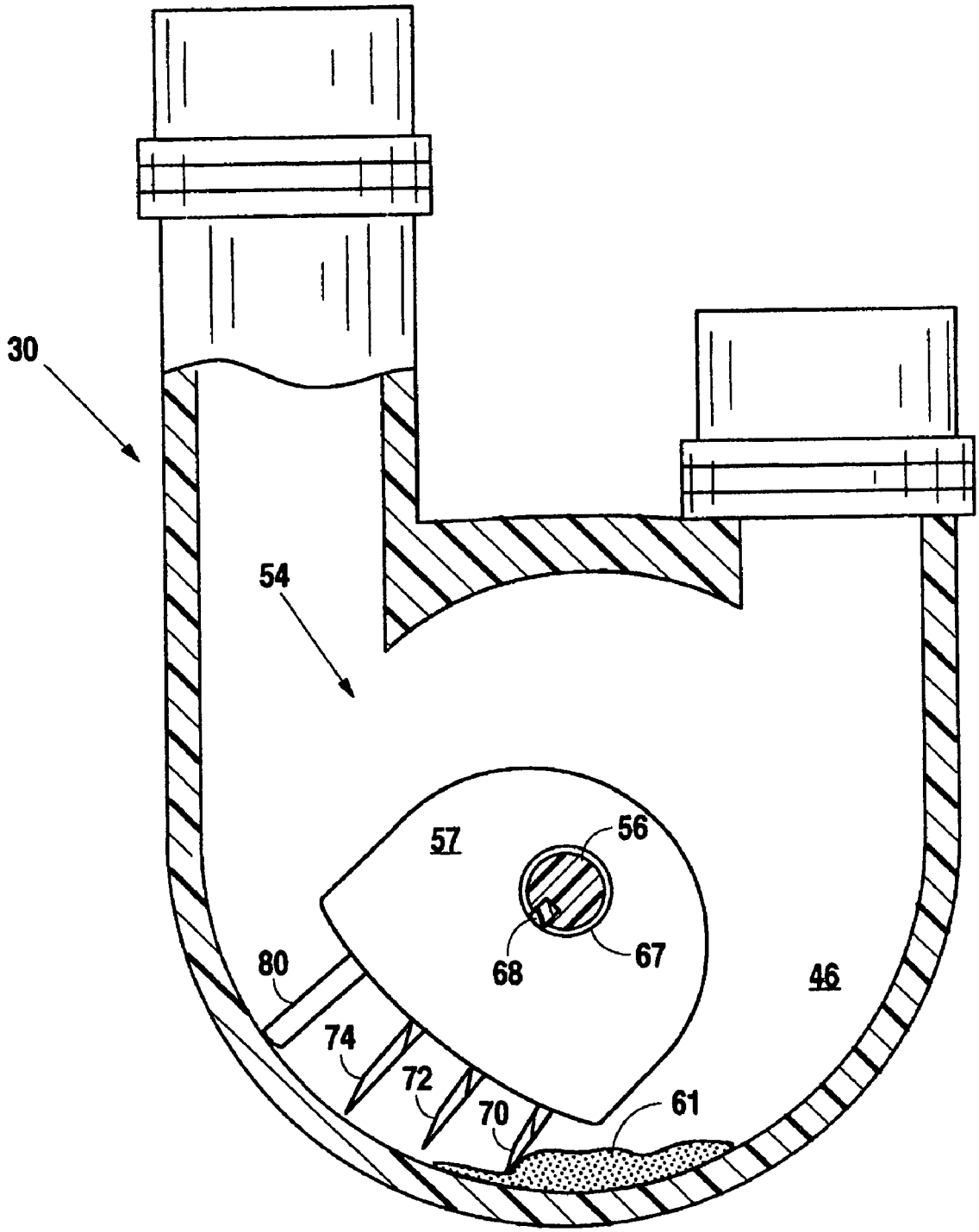
FIG. 2B shows one embodiment of the present invention in a second cleaning position.

FIG. 2A shows a perspective view of an apparatus of the present invention 30 installed in a drainage system. FIG. 2A shows the invention in a first position, while FIG. 2B shows it in a second position.

Figure 3B:
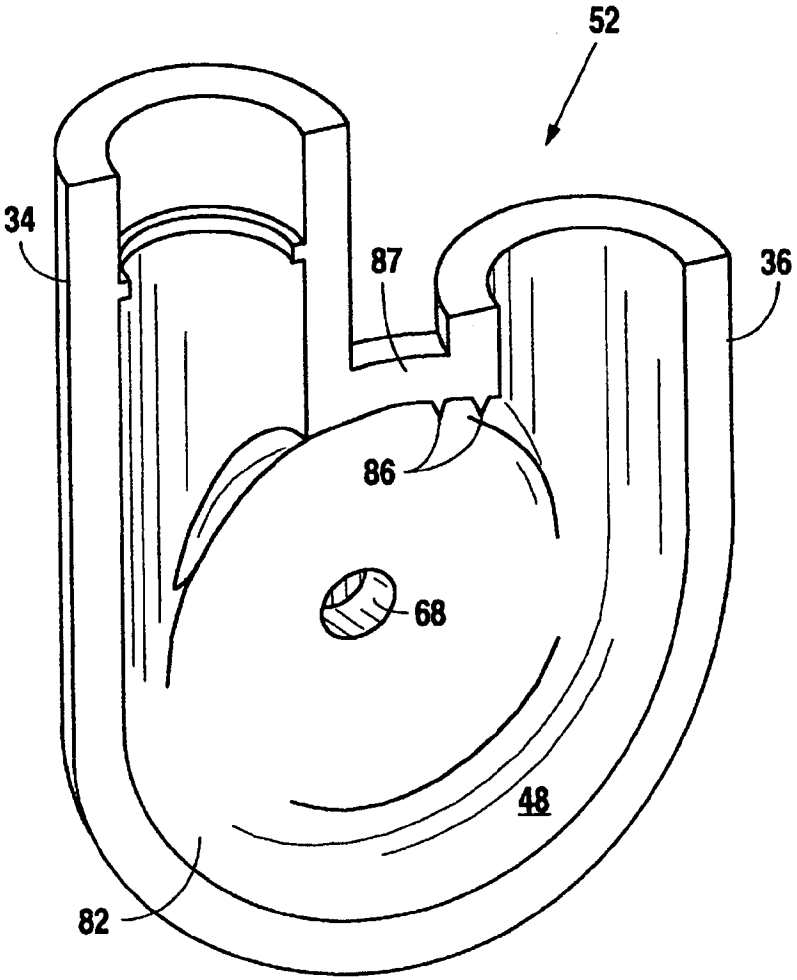
FIG. 3B is an inside perspective view of the half of the split housing assembly of FIG. 3A.
Figure 3A:
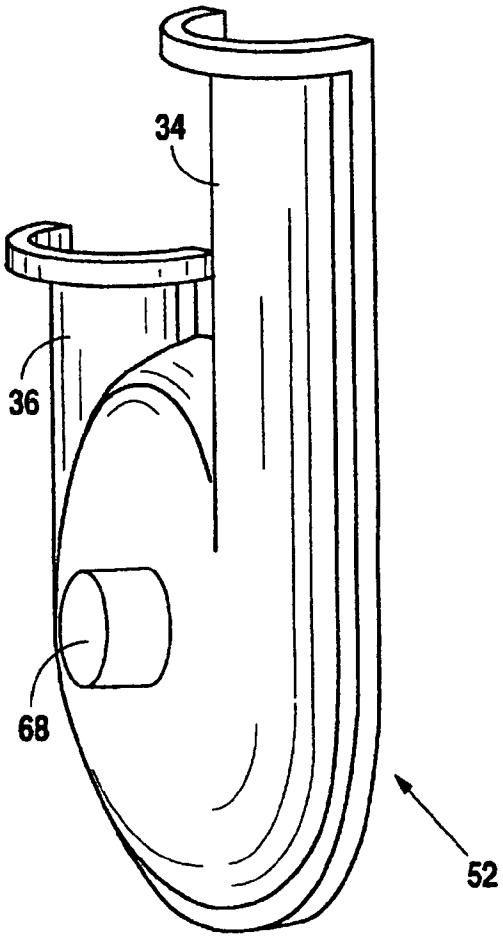
FIG. 3A is an outer perspective view of one half of a split housing assembly of one embodiment of the present invention.
Figure 4B:
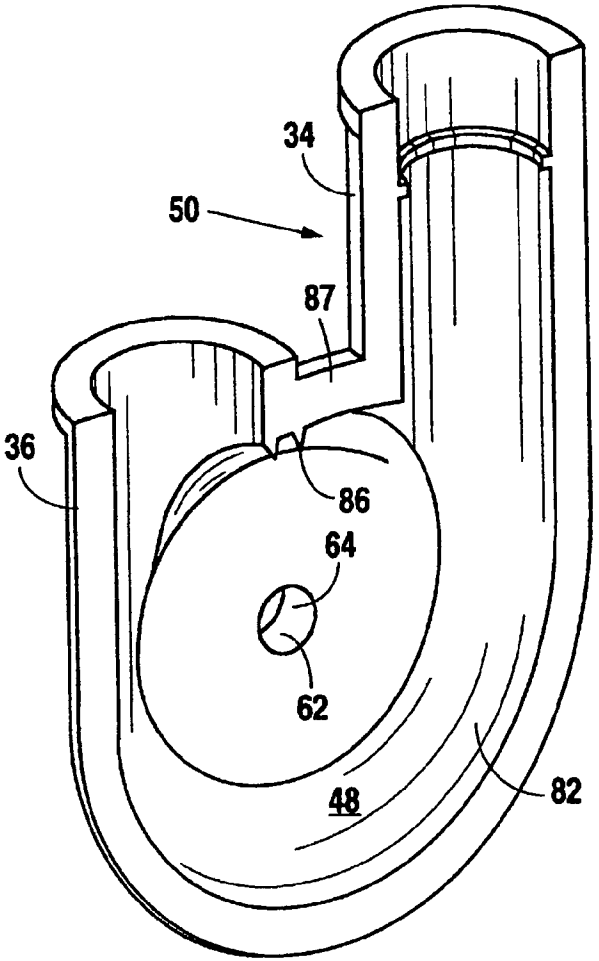
FIG. 4B is an inside perspective view of the second half of the split housing assembly of FIG. 4A.
Figure 4A:
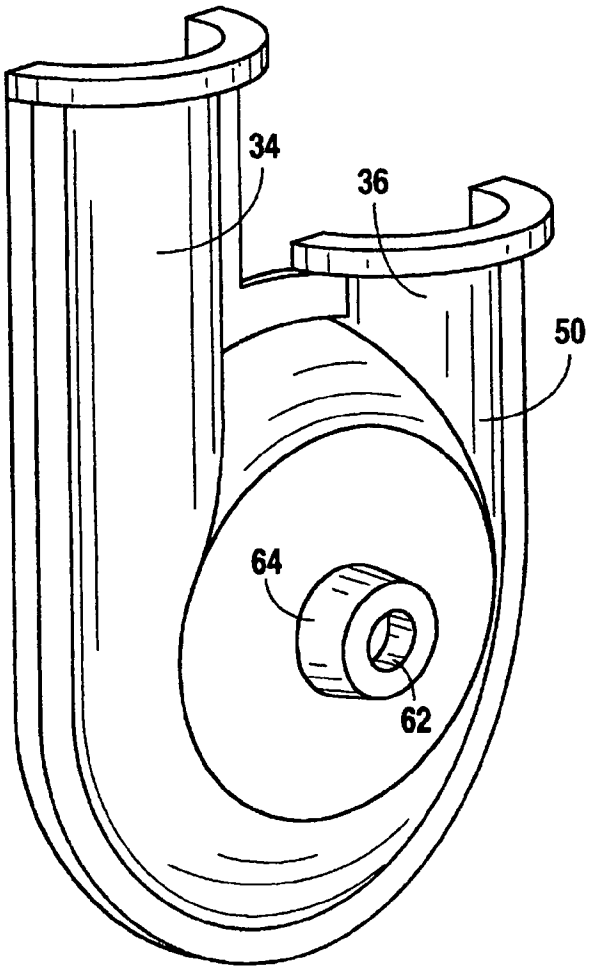
FIG. 4A is an outer perspective view of a second half of a split housing assembly of one embodiment of the present invention.

The apparatus 30 is provided with a transparent, split housing assembly 32 made up of first half 52 (FIGS. 3A and 3B) and second half 50 (FIGS. 4A and 4B). The assembled housing 32 has an inlet leg 34 and an outlet leg 36. Each leg is tubular in shape and is provided with an opening 38 and 40 for connection to a drainage system in a manner well known in the art. FIGS. 2A and 2B show a right-handed trap arrangement, but it should be understood that a left-handed trap could have been illustrated to embody the same invention.

The housing 32 is further provided with a trap section 42 (FIG. 2A) in the bight 44 connecting the inlet leg 34 and the outlet leg 36. The trap section 42 has a fluid flow chamber 46 formed by the inner walls 48 of each housing half 50 and 52.

When the present invention is used as a cleaning device in a pipeline or conduit not involving sewage, there is no need to ensure that no back flow gases flow upstream. There is no need to ensure that there is a blocking water/liquid level in the chamber. Thus, the present invention acts as a conduit cleaning apparatus.

Chamber 46 accommodates a rotatable cleaning member 54 (FIGS. 5A and 5B) which may be rotated by turning a rotational journal or axle 56 attached at one end to a first side 57 (FIG. 5A) of the body portion 58 of the member 54 and a second end to a rotation hub 60 (FIGS. 6A and 6B) on the outside of the axle side of the housing 32. As would be understood by one of ordinary skill in the art, the second end of the journal extends through a journal opening 62 (FIG. 4A) in the side of the first housing half 50. The opening 62 is provided with a journal bearing shoulder 64 and appropriate seals (not shown) to support the axle or journal 56 and prevent leakage around the journal and through the opening 62 (FIGS. 4A and 4B).

The opposite side 59 (FIG. 5B) of the body portion 58 has a support shaft 66 which is axially aligned with the journal 56 and fits into a support shaft bearing shoulder 68 on the inside vertical wall 48 of the second housing half 52 (FIGS. 3A and 3B). Thus, the cleaning member 54 is supported for rotation within chamber 46. FIG. 2B shows the member 54 rotated to a cleaning position.

It should be understood that the support shaft 66 could extend through an opening in side 59, be provided with appropriate seals, and accept a rotation hub. This would enable the cleaning member to be rotated from either side of the house 32 (see FIG. 12).

Figure 5B:
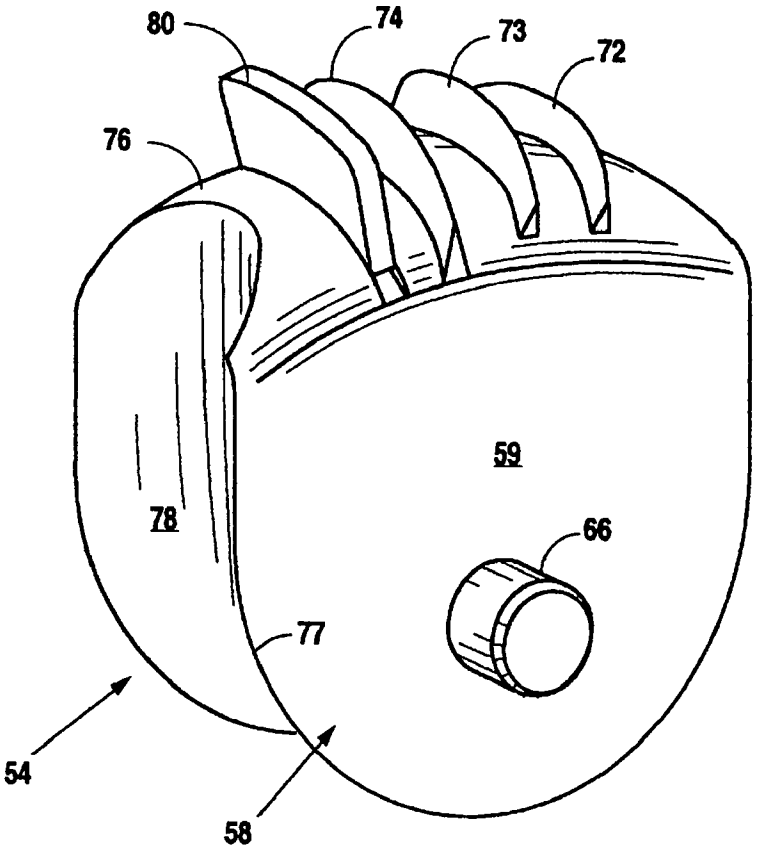
FIG. 5B is a back, perspective view of the cleaning member of FIG. 5A.
Figure 5A:
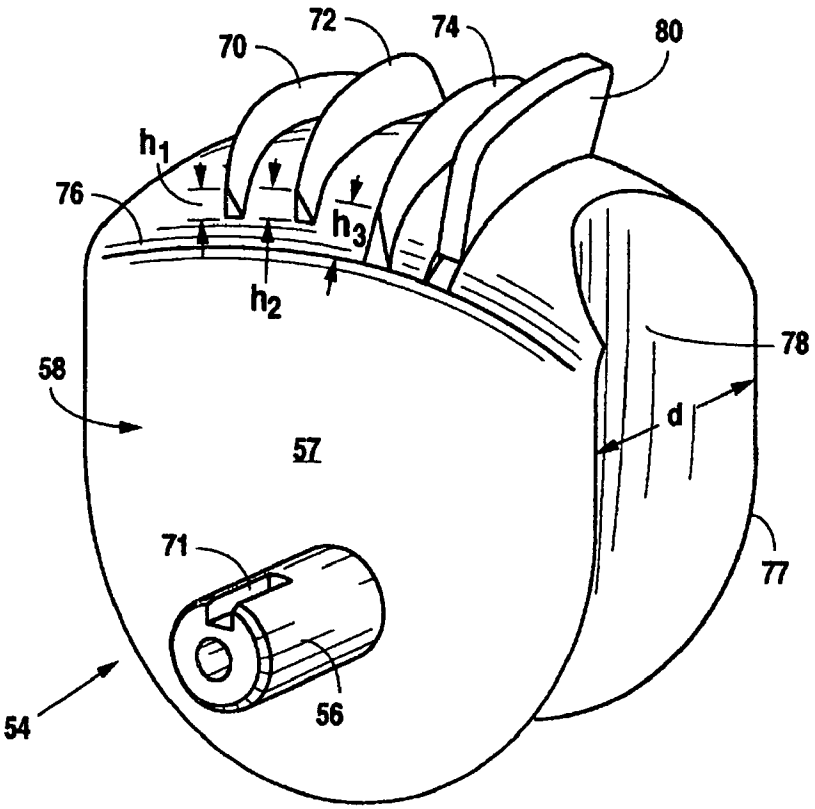
FIG. 5A is a front, perspective view of a cleaning member of one embodiment of the present invention.

Turning to FIGS. 5A and 5B, more details of one embodiment of the cleaning member 54 of the present invention are illustrated. The body portion 58 is generally cam shaped with the rotation journal 56 and the support shaft extending radially from the body member 57 and offset from the center. As will be discussed below, the cam shape allows the member 54 to rotate through the fluid flow chamber 46 yet be maintained in an unobstructing flow position when not being rotated to clean the flow path.

The body portion 58 has a plurality of spaced apart cleaning blades or teeth 70, 72, and 74 extending radially outwardly from a portion of the outer, radial peripheral surface 76 of the body. Each blade has a triangular cross-sectional shape with the height ($h_1$–$h_3$) of each blade successively increasing from the leading blade 70 to the trailing blade 74. As will be described below, this progressive height increase enables the member 54 to shovel, scrape or scoop debris or build-up from the flow path in the bight of the trap. Each blade may be slightly pitched forward or in a shovel or chisel shape to increase its scraping capacity.

As FIGS. 5A and 5B further show, a unique arcuate flow channel 78 is provided in the remainder of the outer peripheral surface 77 of this embodiment of the body 58 to reduce flow resistance through the apparatus 30. The diameter of the arcuate channel $d_c$ is preferably equal to the diameter $d_i$ and $d_o$ of the inlet 34 and outlet 36 legs. FIG. 2A shows the cleaning member in a first, unobstructing position. The arcuate flow channel 78 in the outer surface 77 ensures a full volume flow path through the bight 44 in the trap section 42.

A paddle member 80 is also provided on the cleaning member 54. Paddle 80 may be rigid or flexible as it extends radially outwardly from surface 76. The paddle 80 trails the final blade 74 and in operations, wipes the inner bight walls 82 during rotation moving the loosened sludge or build-up out of the trap section 42 and up the outlet leg 36 to the drain line.

As may be further seen in FIG. 2A, the paddle 80 may itself act as a "locator" for ensuring that the cleaning member 54 is properly positioned within the housing 32 so as to not interfere with normal fluid flow through the apparatus. (Another "locator" system is described below which allows for the proper placement of the cleaning member when not rotating through the flow path.) When the paddle is of rigid composition, locator seat 86 on the upper inner wall section 87 of the housing halves are flexible. This enables the paddle to "lock" or snap between the flexing seat after rotation of the member and thereby hold the member body 58 with blades 70–74 out of the flow path. The user is informed that the paddle is in position by sound and the restriction in movement of the paddle.

When the paddle is "locked," the arcuate channel 78 is thereby positioned in a first position (shown in FIG. 2A) to co-act with the bight walls to allow a full volume flow path through the trap section 42 of chamber 46. When the paddle is of a flexible composition, the seat 86 may be rigid to allow the paddle to flex and "lock" into the first flow position. Seat 86 is formed by two inwardly depending ridges on the inside, upper chamber wall 87 as may be seen in FIGS. 3B and 4B.

Figure 6A:
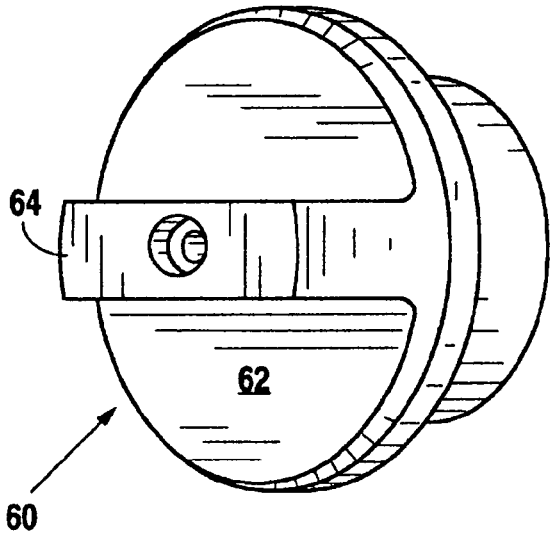
FIG. 6A is a perspective view of the outer side of a rotation hub of one embodiment of the present invention.
Figure 6B:
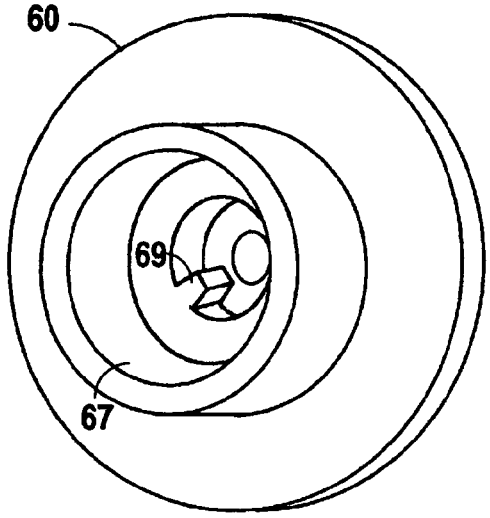
FIG. 6B is a perspective view of the inner side of the rotation hub of FIG. 6A.

FIGS. 6A and 6B show a simple rotation hub 60 which connects to the rotational journal 56 on the cleaning member 54. The hub 60 is provided on the outer cap 62 with a connector 64 which may be affixed to any device to rotate the hub 60 and the journal 56. The inner shoulder 67 of the hub 60 (see FIG. 6B) supports the end of the journal and has a key 69 to engage a keyway 71 on the journal to positively connect the two for rotation. One of the ordinary skill in the art will know of various ways to connect the journal with a device to rotate the cleaning member 54. Alternatively, the cleaning member may be located in the first unobstructing position, by positioning a locator detent tip 187 (see FIG. 6C) on the backside of knob or handle 160 as will be described below.

In operation, the hub 60 is rotated, causing the cleaning member 54 to move from a first, unobstructing position, where paddle 80 is locked out of the flow path by the cooperation of paddle 80 and locator seat 86 (FIG. 2A) to a second, cleaning position wherein the leading blade 70 engages any build-up in the bight flow path (FIG. 2B). Since the leading blade 70 is of a first, lower height than the subsequent blades 72 and 74, it removes or loosens only a portion of the build-up. The next blade 72, being longer, removes or loosens more sludge and so on until the trailing blade 74 (having a height nearly equal to the paddle 80) passes through the bight. The height of the trailing blade 74 is short enough to pass beneath the locator seat 86 on the upper inner wall of the housing 32. Finally, the paddle 80 passes through the bight wiping the inner walls and pushing the loosened build-up or sludge through the chamber and out toward the drain line.

Figure 7:
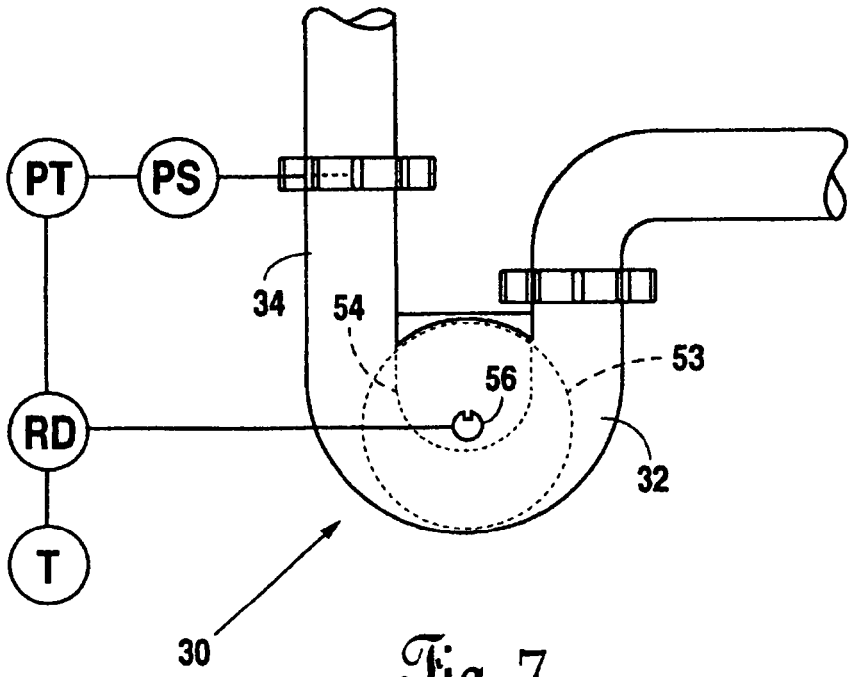
FIG. 7 is a schematic diagram showing a sensor system to activate the embodiments of the present invention.

FIG. 7 shows a schematic diagram of a sensor system connected to the present invention to activate a rotation device RD connected to the cleaning member 54 within the housing. FIG. 7 shows two sensors in the system which causes the cleaning member to rotate through the path shown in broken lines 53. The first is a pressure sensing probe PS inserted into the inlet leg 34 of the housing 32. The probe senses when a predetermined pressure has been reached (indicating a restriction in fluid flow through the apparatus 30) and activates a motor or other driver RD through a pressure transducer PT. In combination, or in the alternative, a timer T may be attached to the rotation device (motor/driver) RD to periodically activate the motor/driver to rotate the cleaning member within the chamber. The timer system has the advantage of activating the operation of the apparatus before large build-ups are accumulated.

It should be understood that the operation of the apparatus may be achieved manually by using the hub 60 itself to rotate the journal.

It has been shown effective to provide a transparent housing 32, so that buildups may be readily observed.

Figure 6C:
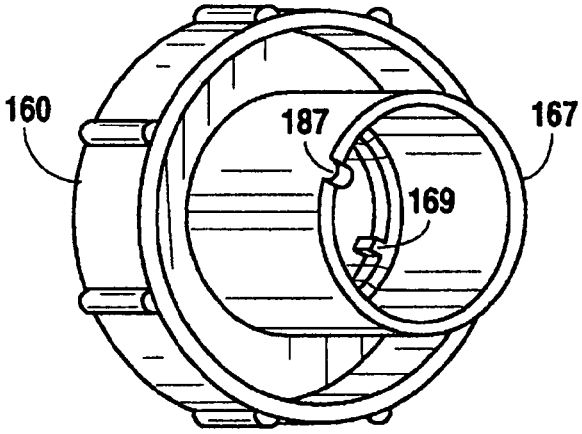
FIG. 6C is a perspective view of a rotation knob with a detent tab.
Figure 9:
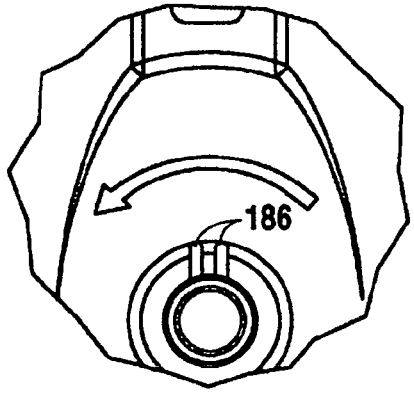
FIG. 9 is a detailed, side elevation view of a portion of the outside of the axle side of the housing of the present invention showing the locator tabs.
Figure 10A:
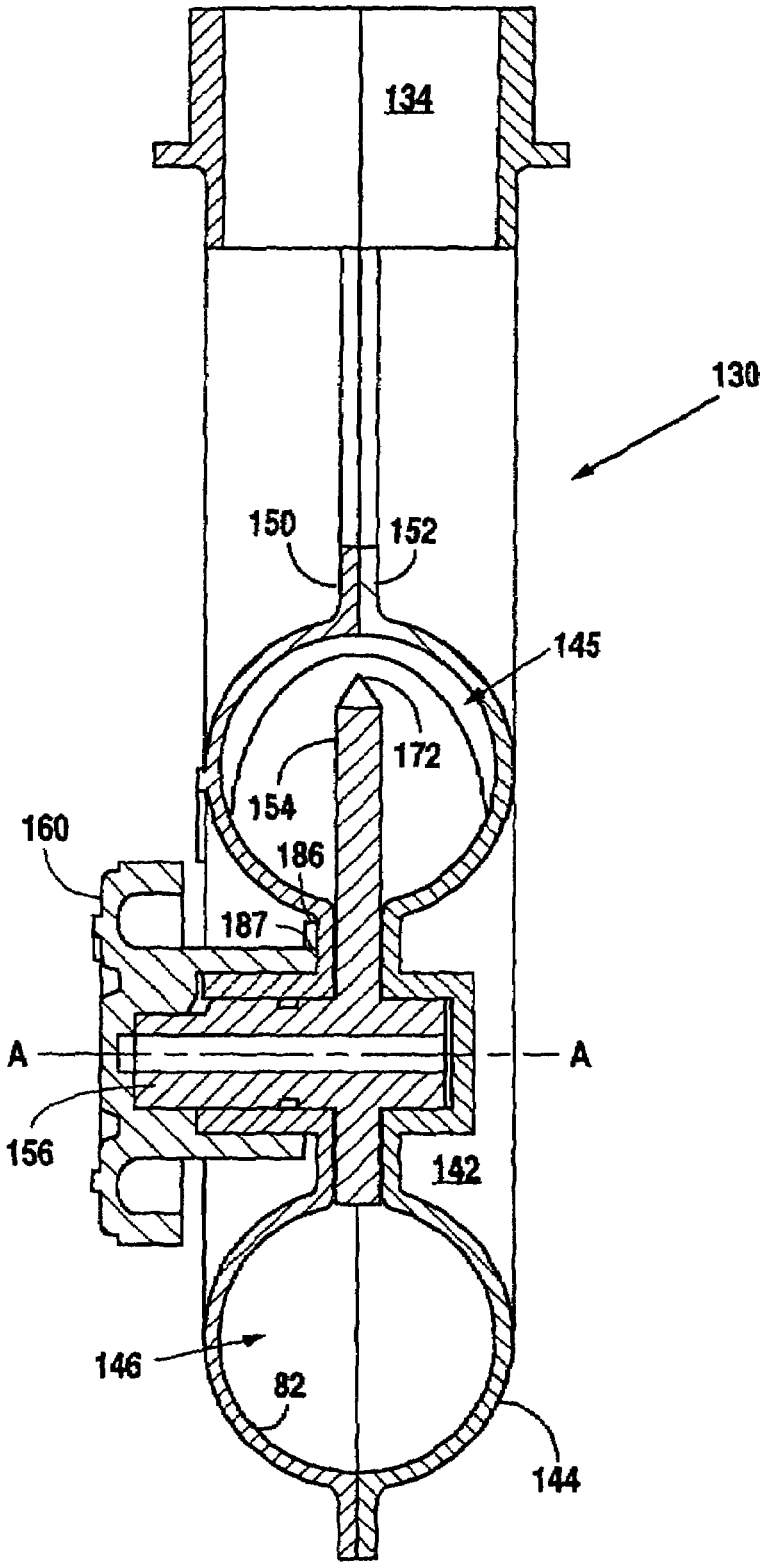
FIG. 10A illustrates a cross-sectional view of the embodiment of FIG. 8 taken along line 10—10.
Figure 10B:
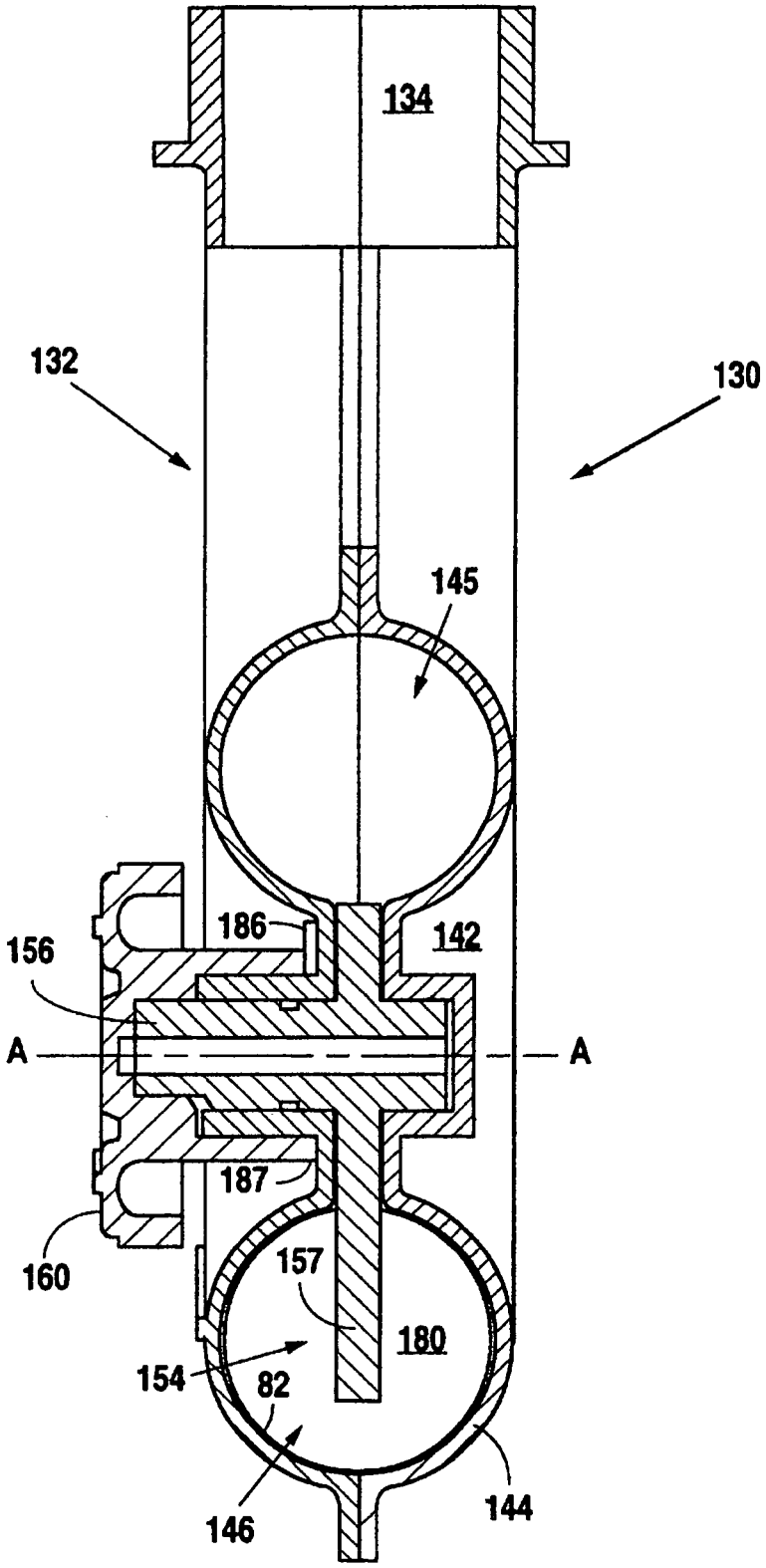
FIG. 10B illustrates a cross-sectional view of the embodiment of FIG. 8 with the cleaning member rotated to the second cleaning position.
Figure 11:
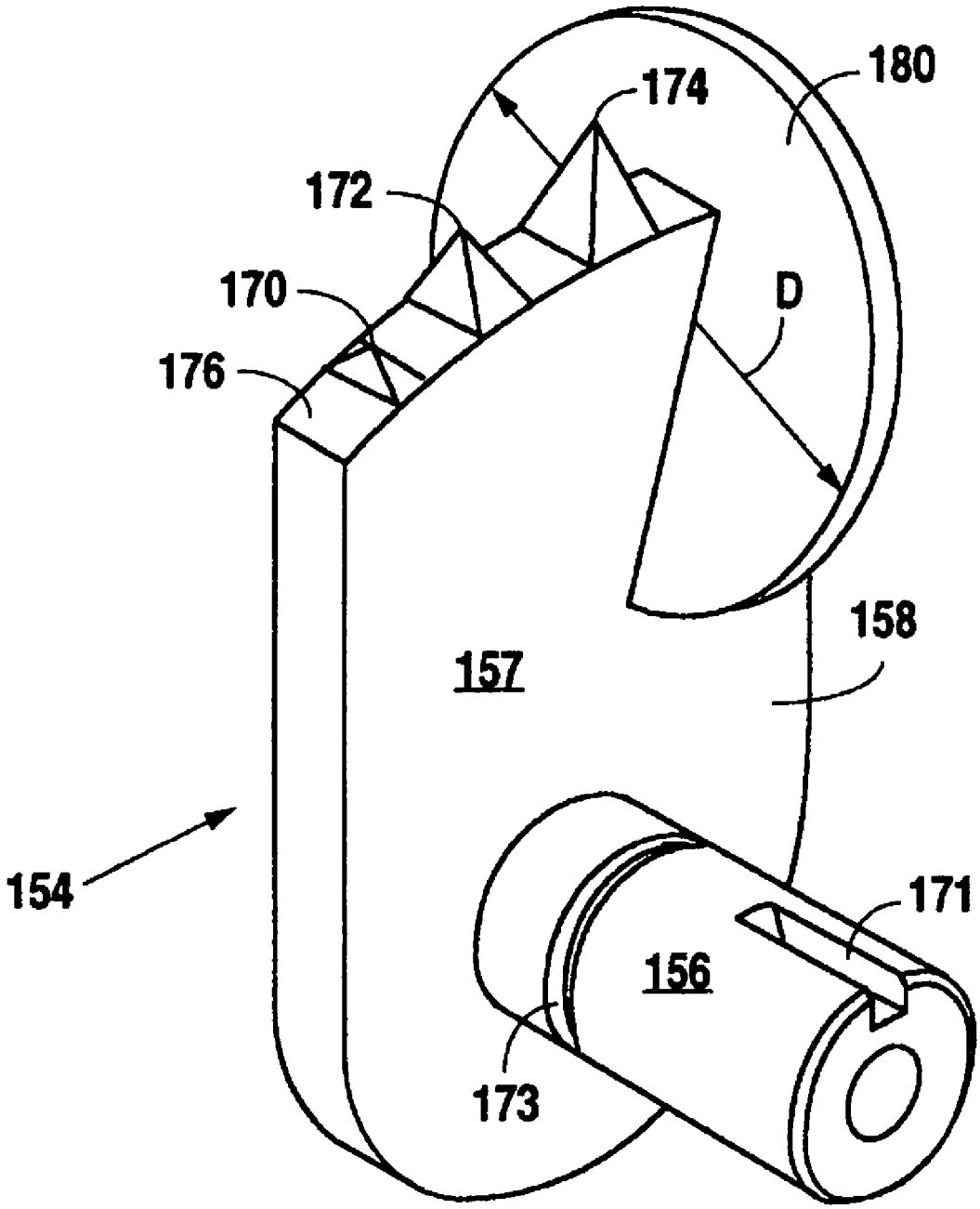
FIG. 11 is a perspective view of the cleaning member of the embodiment of FIG. 8.

FIGS. 8–11 illustrate a simplified embodiment 130 of the present invention wherein the cleaning member 154 has a generally flat, cam-shaped disk body member 158 (FIG. 11). A locator for properly positioning the cleaning member is mounted on the outside of the housing 32 in the form of two small projecting tabs 186 (FIG. 9) which cooperate with a detent tab 187 on the hub or dial knob 160 (FIG. 6C).

Figure 8:
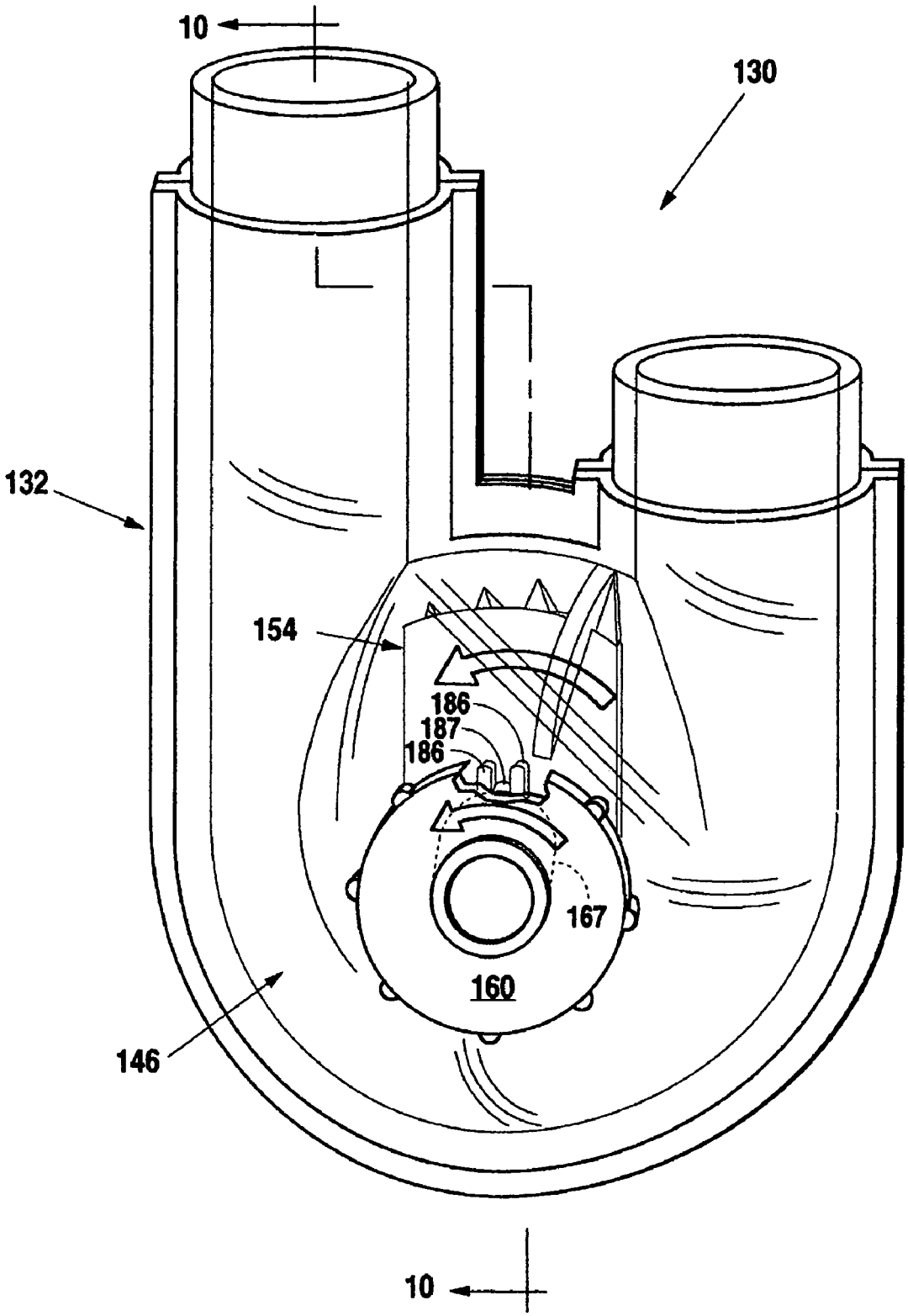
FIG. 8 is a perspective view of an alternative embodiment of the present invention.

The transparent housing 132 of perspective view FIG. 8 discloses the cleaning member 154 in the first, unobstructing position of an upper chamber 145. By rotating the handle 160 in the counterclockwise direction of the arrow, the member 154 moves through the fluid flow path in lower chamber 146 to clear any buildup in the bight of the path. It should be understood from FIG. 8, that the cleaning member does not lie in the normal fluid flow path in this first position.

Two projecting tabs 186 (FIG. 9) are formed into the outside surface of the axle side 150 of the housing 132. These tabs cooperate with the detent tabs 187 (FIG. 6C) on the inner side of the handle 160 to locate the member 154 in the first position. When the handle is properly positioned or keyed to the axle or journal 156, the detent tab 187 is retained between the two projecting tabs 186 in this first position.

FIG. 10A is a cross-sectional view of the embodiment 130 of FIG. 8. It may be seen that the cleaning member 154 rotates out of upper chamber 145 and through lower flow chamber 146 by the rotation of the handle or knob 160, attached to the axle or journal 156. The journal 156 passes through the axle side 150 of the housing 132. The journal 156 is attached to the body portion 158 of the member 154, such that there is cam-like rotation about the axle's axis of rotation A—A. FIG. 10A illustrates how the cleaning member does not obstruct the fluid flow path through the lower chamber 146 when in this first position.

FIG. 10B shows a cross-sectional view with the cleaning member 154 rotated to the second cleaning position. The paddle 180 is wiping the walls of the chamber 146 of debris. It should be noted that fluid flow may be fully maintained through upper chamber 145 during this cleaning process. Thus, an alternative fluid flow path is provided when the cleaning member rotates to the second cleaning position.

When the bight becomes clogged, the sink attached to the other end of the inlet feed line may fill with fluid. With the present invention, as soon as the cleaning member 80 or 180 begins to rotate, an alternative fluid flow path is opened through the upper chamber 145 and the sink may drain while the clog is cleaned.

Further, it has been noted that when the bight is not heavy with debris, the present invention may be used to assist in retrieving an item which has inadvertently fallen into the drain. The item will settle in the nadir of the flow path in chamber 146. The operator may rotate the cleaning member in the opposite (clockwise) direction. The paddle 80 or 180 will urge the item back toward the inlet line. This will allow the operator to more easily insert a tool through the inlet line and retrieve the item.

The cleaning member 154 is illustrated in FIG. 11. In this embodiment, the body portion 158 is a thin, flat, cam-shaped disk with an axle extending from one side 157 thereof. Along an upper section of the outer peripheral surface 176 radially extend several teeth 170, 172, and 174 of gradually increasing height. These teeth cut through any sludge buildup in the bight when the member 154 is rotated. The teeth are shown as pointed, triangularly shaped members, but it should be understood that any functional shape will suffice.

Further, FIG. 11 shows a cleaning paddle 180 with a diameter D, which is attached to the body portion 158 behind the last tooth 174. As discussed with the previous embodiment above, the paddle 180 may be rigid, semi-rigid or flexible as it extends radially outwardly from surface 176. The paddles wipes the inner bight walls 182 of the chamber 146 as the member 154 is rotated by the handle 160 attached to the axle or journal 156. FIG. 11 also illustrates a seal ring groove 173 for accommodating a seal ring when the unit is assembled.

Figure 12:
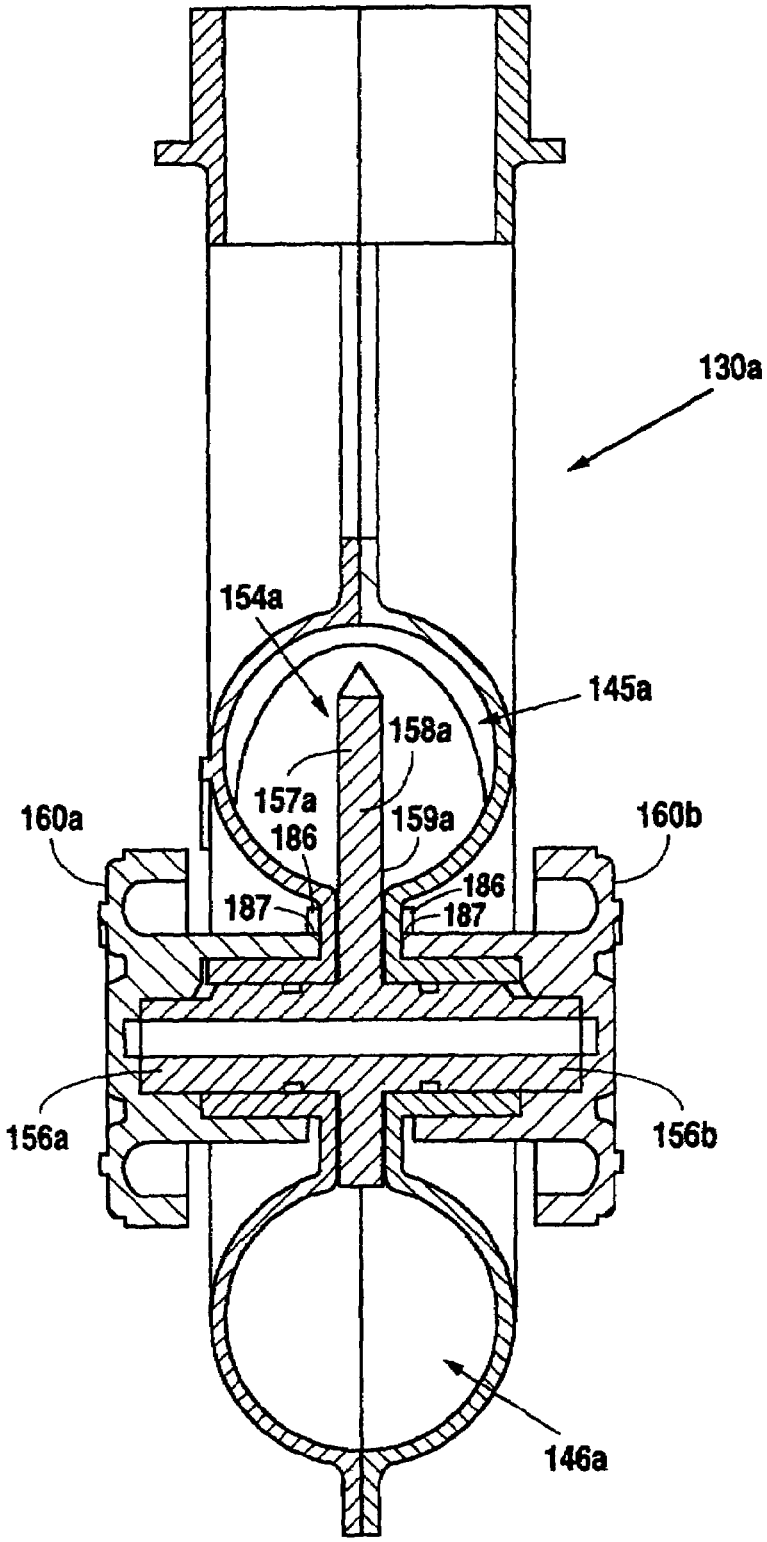
FIG. 12 shows a partial cross-sectional view of an embodiment of the present invention with dual rotation journals.

FIG. 12 is a cross-sectional view of an embodiment 130*a*, wherein both sides 157*a* and 159*a* of the body portion 158*a* of cleaning member 154*a* are provided with axle or journals 156*a* and 156*b*, which extend through the housing walls and are rotatable by handles or knobs 160*a* and 160*b*. This allows for the installation of this embodiment of the present invention 130*a* in situations where gaining access to the handle may be restricted by the existing plumbing configuration.

All of the described embodiments discussed above provide a method for cleaning the fluid flow path between an inlet feed line and an outlet drain line. The method includes the steps of: a) providing an apparatus with a rotatable cleaning member within a housing adapted to be connected to an inlet feed line and an outlet drain line; b) connecting the apparatus to the inlet and drain lines to communicate the feed line with the drain line and form a normal flow path; c) accumulating debris in the flow path; d) first rotating the cleaning member from a first position wherein the cleaning member does not obstruct the normal fluid flow path from the inlet feed line through the apparatus to the outlet drain line to a second cleaning position; and e) further rotating the cleaning member back to the first position wherein the fluid flow path is unobstructed. The method may also include the step of opening an alternative flow path when the cleaning member is in the second cleaning position.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A conduit cleaning apparatus connectable to a fluid inlet feed line and an outlet drain line comprising:

a housing assembly having an inlet, an outlet, a bight portion connecting said inlet and said outlet thereby forming a fluid flow path therebetween, said inlet adapted to be connected to said inlet feed line and said outlet adapted to be connected to said outlet drain line;

a cleaning member rotatably disposed within said housing assembly, said cleaning member having a cleaning blade member extending radially outwardly from a radial surface of said cleaning member;

a wiping paddle member extending radially outwardly from said radial surface of said cleaning member, said paddle member cooperating with a locator assembly on said housing assembly to locate said cleaning member in a first position within said housing assembly unobstructing said fluid flow path; and a rotation device attached to said cleaning member to rotate said cleaning member from said first unobstructing flow position to a second cleaning position, wherein said cleaning blade member comprises one or more teeth spaced apart from said paddle member.

2. The apparatus of claim 1, wherein said cleaning blade member comprises a plurality of spaced apart teeth.

3. The apparatus of claim 2, wherein said plurality of spaced apart teeth increase in radial height from a leading tooth to a trailing tooth.

4. The apparatus of claim 1, wherein said locator assembly comprises a housing location member and a cleaning member location member.

5. The apparatus of claim 4, wherein said housing location member comprises projecting tabs to receive and retain a dent tab of said cleaning member location member.

6. The apparatus of claim 1, wherein said rotation device is attached to a rotation journal attached to a body portion of said cleaning member, said rotation journal offset from a center of said body portion and extending radially therefrom.

7. The apparatus of claim 6, wherein said rotation journal extends radially from two sides of said body portion and said rotation device is attachable to either or both of said sides of said body portion.

8. The apparatus of claim 1, wherein said cleaning member is disposed within a first upper chamber within said housing when in said first unobstructing flow position.

9. The apparatus of claim 8, wherein said cleaning member is disposed within a second lower chamber within said housing when said cleaning member is in said second cleaning position.

10. The apparatus of claim 9, wherein said inlet and said outlet are in fluid communication via said first upper chamber when said cleaning member is in said second cleaning position.

11. The apparatus of claim 1 wherein said cleaning member has an arcuate channel extending around a portion of said radial surface.

12. The apparatus of claim 1 wherein said cleaning member has a cam shaped body portion with a rotation journal offset from a center of said body portion and extending axially therefrom.

13. The apparatus of claim 1 further comprising a sensor to activate or rotate said rotation device.

14. The apparatus of claim 13 wherein said sensor comprises a pressure sensing probe in said inlet of said housing and a pressure transducer to activate said rotation device.

15. The apparatus of claim 13 wherein said sensor comprises a timer to activate said rotation device.

16. A method of cleaning debris from a fluid flow path between an inlet feed line and an outlet drain line comprising the steps of:

a) providing an apparatus with a rotatable cleaning member within a housing having said fluid flow path, said cleaning member having a cleaning blade member extending radially outwardly from a radial surface of said cleaning member, said cleaning blade member having one or more teeth spaced apart from a wiping paddle member extending radially from said radial surface of said cleaning member, said housing adapted to be connected to said inlet feed line and said outlet drain line;

b) connecting said apparatus to said inlet feed line and said outlet drain line to communicate said feed line and said drain line via said flow path;

c) accumulating debris in said flow path;

d) first rotating said cleaning member from a first position not obstructing said flow path to a second cleaning to clean said debris from said flow path; and e) further rotating said cleaning member back to said first position wherein said flow path is unobstructed.

17. The method of claim 16 further comprising the step of:

simultaneously opening an alternative flow path between said inlet feed line and said outlet drain line through said housing when said cleaning member is first rotated.

18. The method of claim 16 wherein said apparatus comprises a locator assembly on said housing for positioning said cleaning member in said first position within said housing.

* * * * *